US006361235B1

(12) United States Patent
Riedrich

(10) Patent No.: US 6,361,235 B1
(45) Date of Patent: Mar. 26, 2002

(54) DEVICE FOR BINDING TOGETHER A STACK OF DOCUMENT SHEETS

(76) Inventor: Gert Riedrich, Komotauer Strasse 8, Feucht (DE), DE-90537

( * ) Notice: Subject to any disclaimer, the term of this patent is extended or adjusted under 35 U.S.C. 154(b) by 0 days.

(21) Appl. No.: 09/614,630

(22) Filed: Jul. 12, 2000

(30) Foreign Application Priority Data

Apr. 4, 2000 (DE) ..... 200 06 088 U

(51) Int. Cl.[7] ..... B42F 13/12

(52) U.S. Cl. ..... 402/60; 402/61; 402/62; 402/68; 402/63

(58) Field of Search ..... 402/68, 60, 61, 402/64, 67, 8, 62, 63, 80 R, 80 P; 281/21.1, 15.1, 28, 51

(56) References Cited

U.S. PATENT DOCUMENTS 4,305,675 A * 12/1981 Jacinto ..... 402/68 X
5,011,318 A * 4/1991 Gilmore ..... 402/68 X

FOREIGN PATENT DOCUMENTS

EP 0 654 362 5/1995

* cited by examiner

*Primary Examiner*—Willmon Fridie, Jr.
(74) *Attorney, Agent, or Firm*—Frank H. Foster; Kremblas, Foster, Phillips & Pollick

(57) ABSTRACT

A device for binding together a stack of document sheets and optionally for depositing such a bound stack in a file with a filing mechanism, comprising a base plate to be disposed below the document stack, a cover plate to be disposed on the document stack, at least one flexible binding tongue strip which is fixable and/or fixed to the base plate and whose two binding tongues, for the purpose of binding together the document sheets, are threaded through paired perforations in the document stack and the cover plate and are bent back at the ends on to the cover plate above the document stack, as well as at least one cover rail mountable on the cover plate, including the binding tongue ends, with undercuts on the longitudinal edges for encompassing the longitudinal edges of the cover plate, whereby the cover rail is divided into two in its longitudinal direction, so that the two parts are mountable from opposite end faces on the cover plate.

16 Claims, 5 Drawing Sheets

DEVICE FOR BINDING TOGETHER A STACK OF DOCUMENT SHEETS

Figure 1:
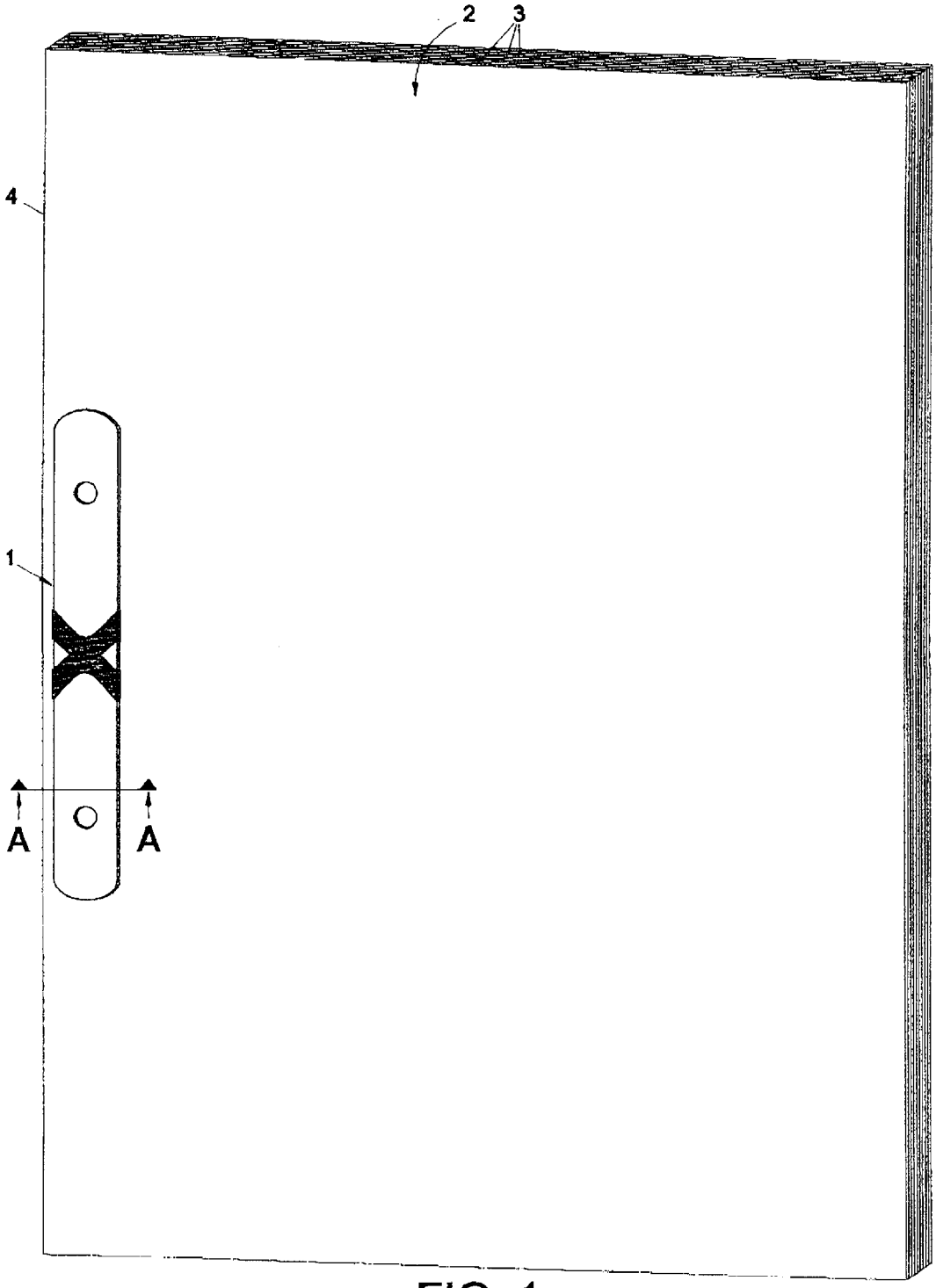

The invention relates to a device for binding together a stack of document sheets and optionally for depositing such a bound stack in a file with a filing mechanism, comprising a base plate to be disposed below the document stack, a cover plate to be disposed on the document stack, at least one flexible binding tongue strip fixable and/or fixed to the base plate, whose two binding tongues, for the purpose of binding together the document sheets, are threaded through paired perforations in the document stack and the cover plate and are bent back at the ends on to the cover plate above the document stack, as well as at least one cover profile rail mountable on the cover plate, including the binding tongue ends, with undercut longitudinal edges for encompassing the longitudinal edges of the cover plate.

A device of this type is disclosed in European Patent 0 654 362 by the Applicant. This has a first feature in that the bent-back binding tongue plates are slightly inclined relative to the longitudinal axis of the cover plate and therefore run past next to one another. The one-piece, mounted cover profile bar therefore in every case finds a frictionally locking grip, since in the closed position neither locking nor hooking on the bent-back binding tongue ends is possible. The cover profile bar can therefore slip down from the cover plate if the document stack concerned is taken from a file, so that perforations penetrating all layers of the stack as well as the binding mechanism are no longer penetrated by the file clips. In Such a case there is a risk that the cover profile bar can pass unnoticed into an exposed position and can for example be bent there. Furthermore, in order to open the binding mechanism it is necessary to push the cover bar completely down from the cover plate, as it might otherwise also be bent. This has the result that after every removal of a sheet, the cover bar then has to be threaded back intricately on to the cover plate.

From the disadvantages of the described prior art arises the problem underlying the invention of so improving a binding device of this type that the cover profile rail can if possible remain connected to the cover plate even for the removal of one or more sheets, so that handling of the binding device is further simplified. Furthermore, the binding device is to be so formed that the risk of accidental damage due to incorrect handling is as small as possible.

This problem is solved according to the invention in that the cover profile rail is divided into two in its longitudinal direction, in such a manner that the two parts are mountable on the cover plate from opposite ends.

Since by dividing the cover profile rail the effective length of a part thereof is significantly reduced, the unfavourable leverage between the cover plate and the cover bar pushed down by the central binding region thereof is reduced, so that there is no risk of damage to the binding mechanism, even if both cover profile rail parts are not pushed down completely by the cover plate. Therefore handling is eased, since after removal or sorting of one or more sheets the cover profile rail does not have to be pushed back on to the cover plate in a time-consuming manner, but rather the cover profile parts remaining therein only have to be pushed back together.

It has been found advantageous that the cover profile rail is divided centrally so that the cover profile rail parts have an identical shape. By this step it can be achieved that both cover profile rail parts are produced with the same injection mould, so that the cost of manufacturing injection moulds is minimal in spite of the increase in number of moving parts of the binding device according to the invention.

It is within the scope of the invention that the cover profile parts have on their impact edge a respective projection which extends roughly over half their length and which corresponds to a recess in the other section of the edge. Thus a visibly tight connection is achieved between the two cover profile rail parts, so that the cover plate is not visible even if the cover profile rail parts are slightly displaced.

Further advantages are achieved if the cover profile rail parts have in the region of their edge profiling which increases the skid-resisting properties, e.g. in the form of fluting. During the opening and closing movement of the cover profile rail parts, their region abutting the edge undergoes permanently guidance along the common cover pate, so that this region is particularly suited to actuation of the cover profile rail parts. Since the cover profile rail parts due to their small cross-section can be touched particularly on the surface, but not actually grasped, the profiling according to the invention ensures adequate friction locking during opening or closing.

It has further proved advantageous that the profiled grip regions are provided on the upper face as well as on both longitudinal edges of the cover profile rail parts. Thus a person has the option for actuation of only placing one finger on the cover profile rail part concerned or to grasp both its longitudinal edges with two fingers.

The user-friendliness can be further increased if the profiled grip regions are formed proud. In this case, the friction-locking effect of the profiling is complemented by positive locking on the shoulder formed by the proud region, so that the reliability in actuation is further improved.

The invention permits an improvement in that the profiled and/or proud grip regions have an arrow-like shape pointing in the insertion direction. Thus these regions indicate unequivocally the closing direction of the cover profile rail parts according to the invention, and these arrows can complement one another in the fully pushed-together state to form an "X", which shows at a glance that the cover profile rail is closed.

The invention further provides that the undercut of the cover profile rail parts is guided continuously round its peripheral end face. Thereby, the closing movement of a cover profile rail part is limited, even if the other cover profile rail part is still open, so that these cannot assume any undefined positions. Furthermore, this encompassing undercut increases the strength of the respective cover profile rail part in the transverse direction, so that unwanted transverse arching is avoided.

The invention offers the further option of giving the cover profile rail parts a perforation each, which lies flush with a respective perforation on the base plate and the cover plate. These perforations on the one hand have the purpose of permitting an additional option of depositing the bound stack in a file or the like, on the other hand the cover profile rail parts form in this case positive locking with the clips of the file concerned and are thereby fixed also in their sliding direction along the cover plate, so that accidental mounting is fully excluded.

The invention can be developed further in that the cover profile rail parts have at the regions adjacent to the edge projections which extend into the undercut region and which can pass into engagement with lateral lugs and/or shoulders on the longitudinal edges of the cover plate in order thereby to counteract opening movement of the cover profile rail part concerned. This design feature serves the purpose of preventing unintentional detachment of the cover profile rail parts from the cover plate, even if the sliding movement is not suppressed by clips of a hole punch penetrating corresponding perforations. In such a case, even if a file is being transported or the like, no parts of the binding mechanism according to the invention can be lost, so that their operativeness is permanently ensured.

This design specification can be realised if at the longitudinal edges of the cover plate close to their end faces shoulders are provided which widen towards the same and which in the open position of the cover profile rail parts pass into contact with the projections projecting into the undercut region and thereby define the opening movement. Since the shaping elements of the cover plate counteracting detachment of the cover profile rail parts from the cover plate are formed as a shoulder, they acquire a maximum of strength, so that unwanted deformation of the cover plate in this region is almost impossible and the cover profile rail parts cannot slide beyond the respective shoulders unnoticed. Since, on the other hand, these shoulders are disposed preferably laterally respectively outside inner perforations for the binding of individual sheets of the respective document stack, the two cover profile rail parts can however be pulled so far apart that the binding tongue plates can be comfortably raised and then the cover plate can be then raised with the cover profile rail parts suspended thereon in order to remove individual sheets of the document stack or to add further sheets.

In a further improved embodiment, at the longitudinal edges of the cover plate, close to its centre, lateral lugs can be provided, behind which the projections of the cover profile rail parts projecting into the undercut region can engage for locking in their closed position.

These lugs permit one or both cover profile rail parts to be fixed in the closed position, so that the opening forces acting during a storage period on the cover profile rail parts are absorbed, even if the storage is not effected in a file whose clips penetrate peripheral perforations of the various layers of the binding mechanism according to the invention.

Particularly in this last embodiment, additional leading eyes can be provided on the longitudinal edges or on the upper face of the cover profile rail parts close to their butt joint, through which a wire, e.g. provided with leading, can be threaded, so that opening of the cover profile rails necessarily brings about destruction of the leading and is therefore immediately recognisable.

Preferably, at both longitudinal edges of the cover profile rail parts such leading eyes are provided, so that with the use of identical cover profile rail parts respectively two eyes are available on the same longitudinal edge of the cover profile rails. Although a similar effect could be achieved by providing an eve on the tipper face of the cover profile rail parts, this would lead to an additional increase of the structural height of the binding mechanism according to the invention, so that the depositing capacity of a file would be reduced. This disadvantage can be substantially avoided by disposing the leading eyes on the longitudinal edges of the cover profile rail parts.

The invention permits a further embodiment in that the cover plate has roughly centrally between the two end faces a widening, such that the projections abutting the same in the closed position and projecting into tile undercut region, of the cover profile rail parts compress the longitudinal edges of the cover plate, forming a slight transverse arching thereof. Since the cover profile rail parts engage under the cover plate, this could be lifted from the document stack so that an unattractive convexity of the centrally divided cover device might arise. By the transverse arching of the cover plate bent up in the region of its longitudinal edges, the cover plate gains its tension, which favours a straight-stretched shape of the cover plate and therefore also of the cover profile rail mounted thereon, so that also in spite of its division, the individual cover profile rail parts adopt a position exactly flush with one another, which promotes the compactness of the document stack bound together.

By the invention, an arrangement is preferred wherein the cover plate has in the region between its inner perforations a groove-like recess for the insertion of the bent-back binding tongue ends. Since this recess is formed continuously preferably between the inner perforations, the binding tongue ends can fit therein, irrespectively of how thick the bound document stack is. The important point for this is in particular that the cross-section of the groove-like recess corresponds roughly to the cross-section of the binding tongue ends or is slightly larger. In such a case, the cover profile rail parts can slide comfortably beyond the bent-back binding tongue ends, and catching thereof is in any case prevented by the fact that the two cover profile rail parts are only pushed respectively as far as the centre of the cover plate and in this case automatically press the binding tongue ends downwards.

Finally, it corresponds to the teaching of the invention that the cover plate and/or the cover profile rail parts are extended beyond the outer perforations, in particular preferably about by 1.5 to 2.5 times the width of the cover plate or about by 3 to 4 times the perforation diameter. This ensures that the opened cover profile rail parts always remain mounted on the cover plate by a sufficient amount, even if they are pulled out up to the shoulder defining, the opening movement, so that the forces exerted on the cover plate acting as a guide by the inner faces of the undercuts of the cover profile rail parts remain small and therefore damage to the binding mechanism is substantially eliminated even during incorrect handling.

Figure 2:
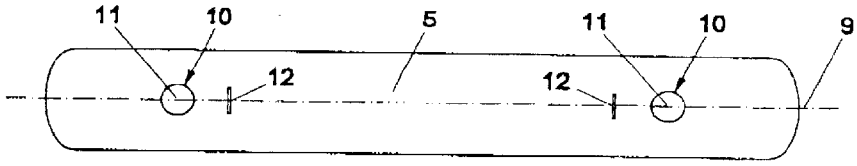
Figure 3A:
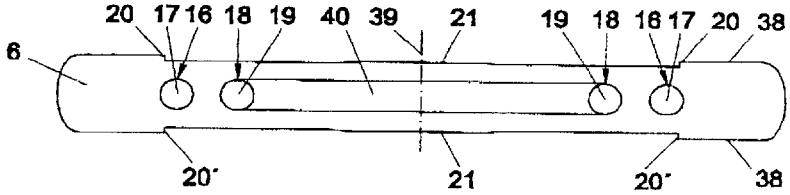
Figure 3B:
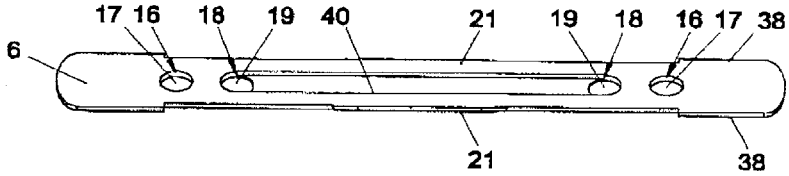
Figure 4:
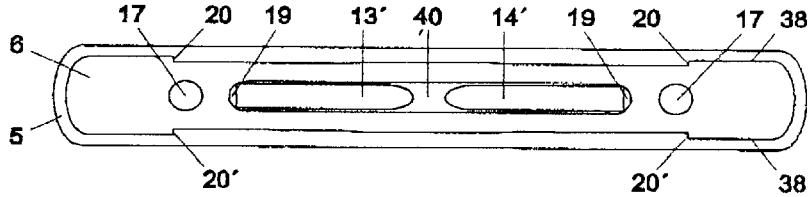
Figure 5:
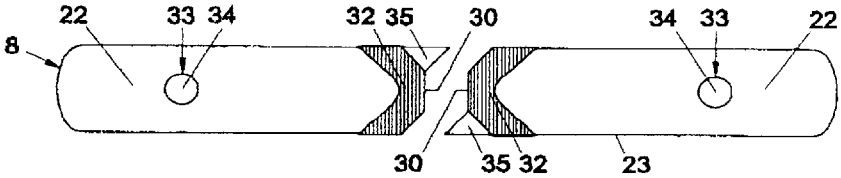
Figure 6:
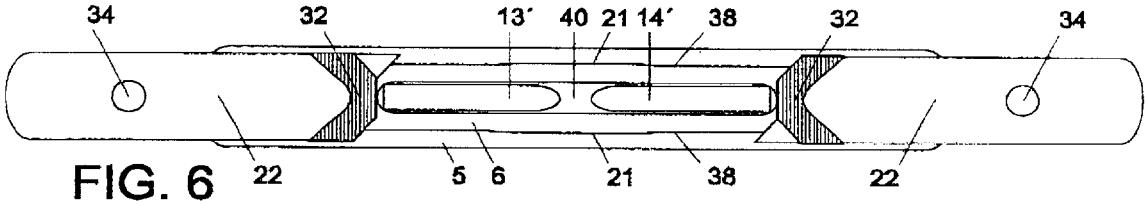
Figure 7:
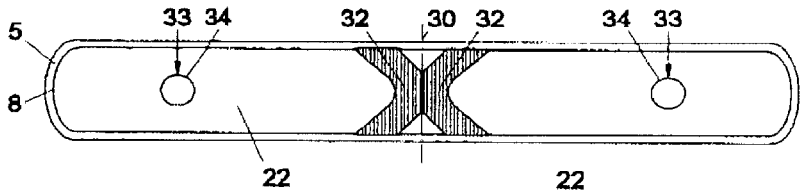
Figure 8A:
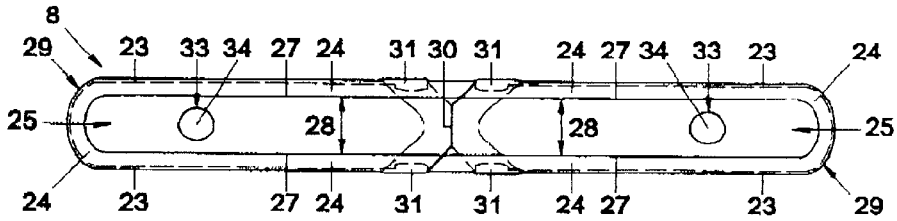
Figure 8B:
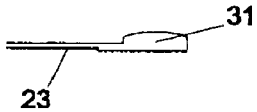
Figure 8C:
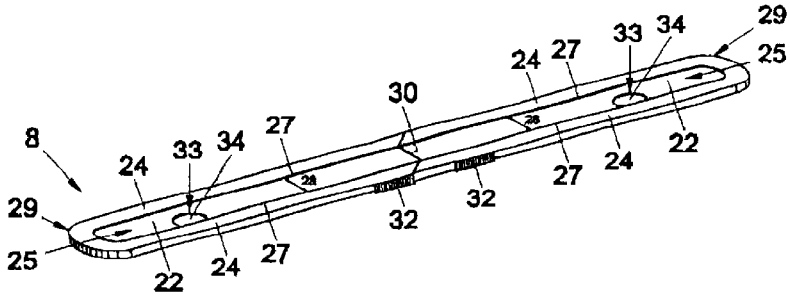
Figure 9:
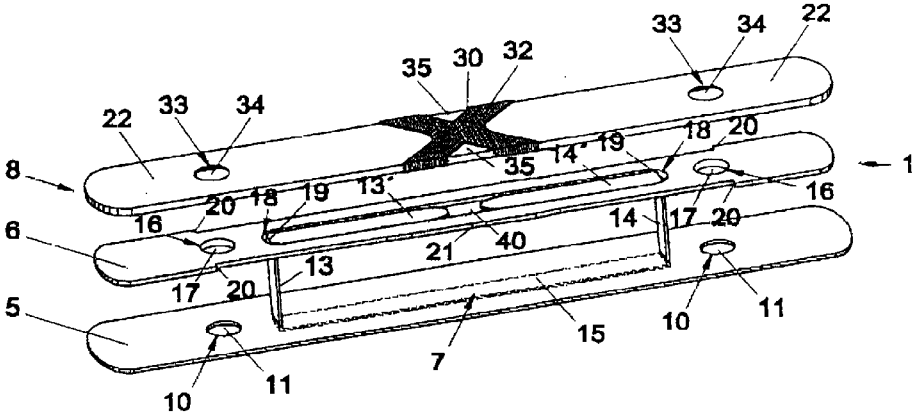
Figure 10:
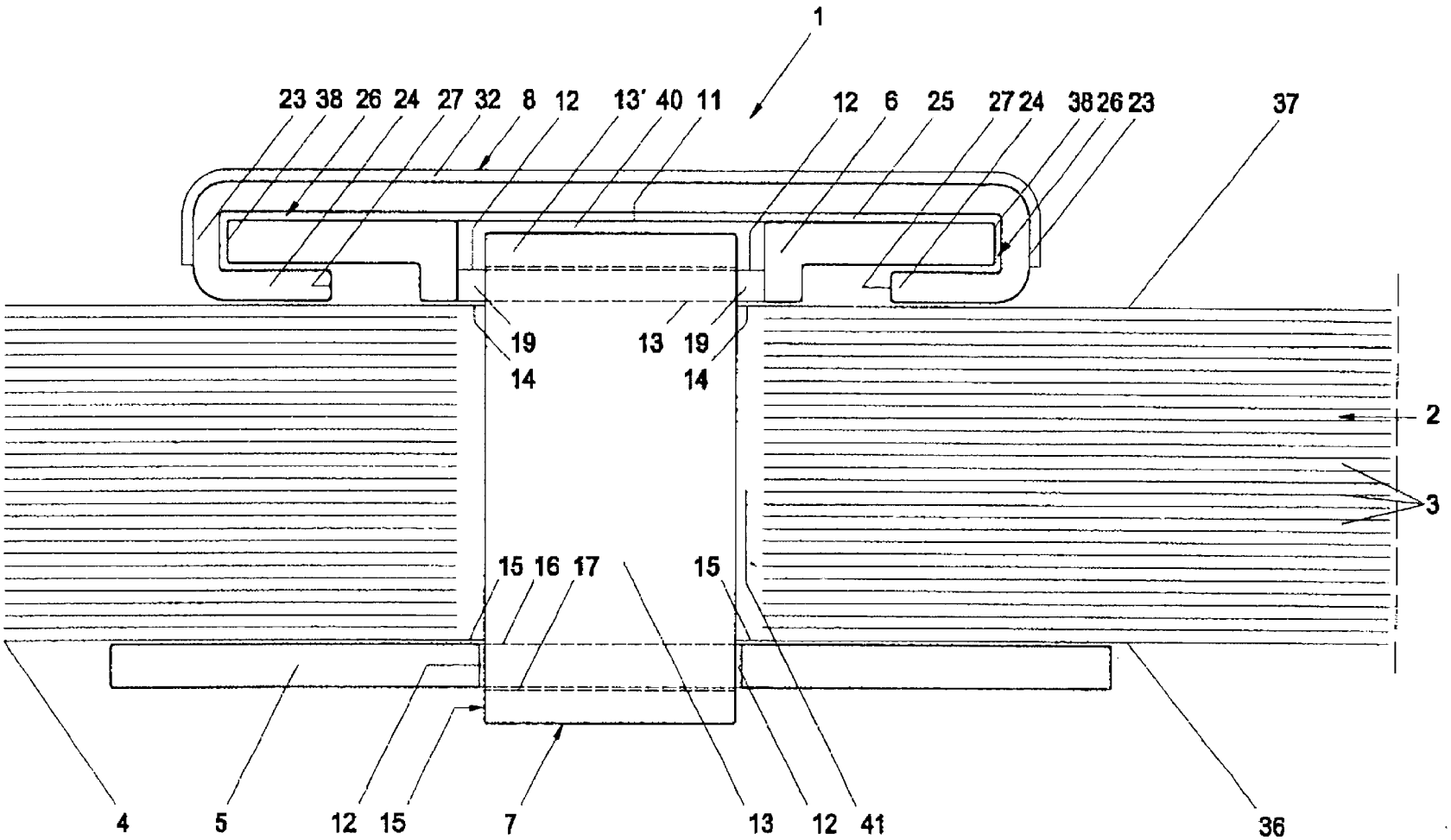

Further features, details, advantages and effects of the invention will appear from the following description of a preferred embodiment of the invention and with the aid of the drawing, which shows:

FIG. 1 a perspective view of a document stack bound together with a binding device according to the invention FIG. 2 a plan view of a base plate of the binding device, FIGS. 3*a*/*b* a plan view of a cover plate of the binding device or a view thereof in perspective, FIG. 4 a plan view of the cover plate with the binding tongue ends in the position of use, FIG. 5 a plan view of the cover profile rail, divided into two, of the binding device, FIG. 6 a plan view of the cover profile rail in the open state over the cover and base plate with the binding tongues, FIG. 7 a plan view of the closed cover profile rail, FIGS. 8*a*/*b* a view from below of the cover profile rail or a plan view of the insertion stop, FIG. 8*c* a view from below in perspective of the closed cover profile rail, FIG. 9 an exploded view of the binding device, FIG. 10 a vertical section along the line A—A in FIG. 1

Figure 11:
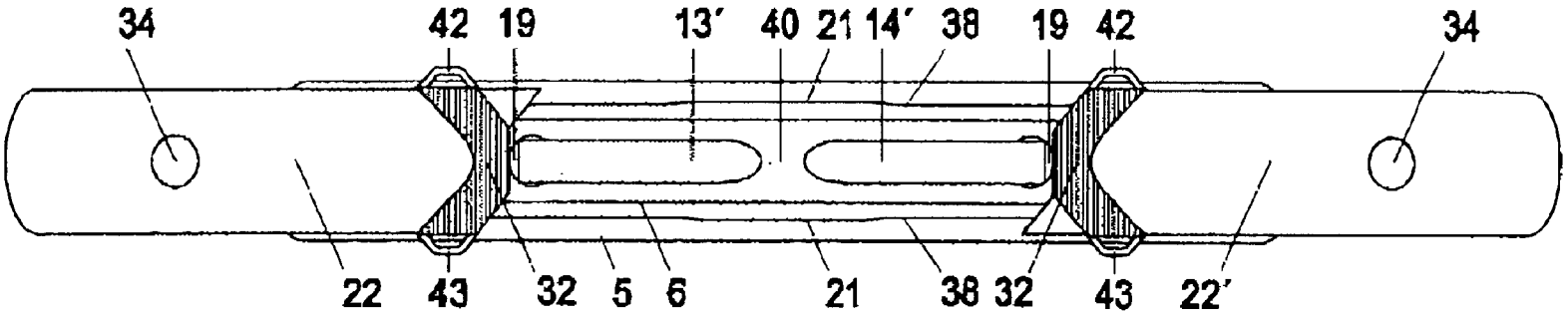
Figure 12:
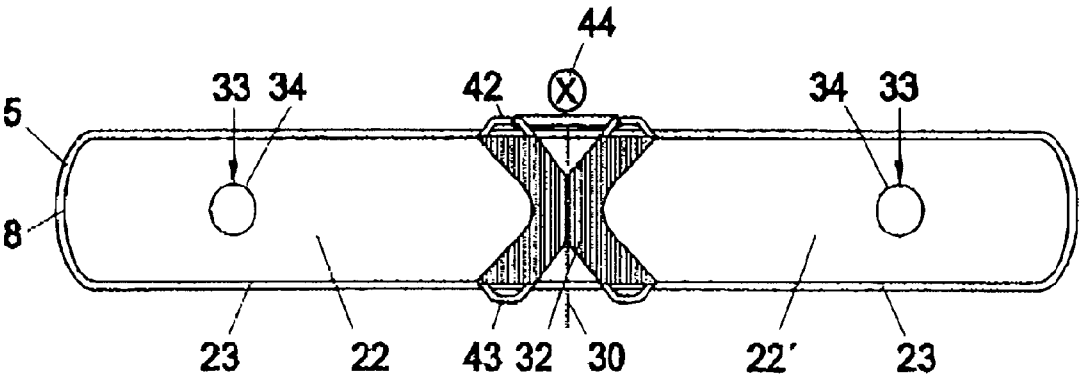

FIG. 11 a plan view of the cover rail divided into two with the leading eyes in the open state, and FIG. 12 a plan view of the cover rail divided into two with the leading eyes in the closed state.

As can be deduced from FIG. 1, the binding device 1 serves to bind together a document stack 2, which e.g. consists of a large number of DIN A4 sheets 3. The binding device 1 in this case rests, according to DIN, centrally at the left-hand edge—what is known as the binding edge 4—of the document stack 2.

From FIGS. 2 to 10, the construction of the binding device 1 can be deduced. It consists of a substantially rectangular base plate 5 composed of flexible resilient flat material with rounded corners (FIG. 2), a strip-shaped, profiled cover plate 6 (FIG. 3*a* and 3*b* respectively) of non-flexible plastics material or preferably sheet metal, a binding tongue strip 7 (FIG. 10), which is composed of a sheet metal, possibly plastics-coated, or from a non-flexible plastics material, and a relatively non-flexible, plastics, centrally divided cover profile rail 9 (FIGS. 5, 6 and 7).

The base plate 5 (FIG. 2) has centrally to its longitudinal centre line 9 a perforation 10, which consists of two holes 11 spaced at a distance complying with the standard. The base plate 5 is also provided with two fixing slots 12 extending transverse to its longitudinal centre line 9, which rest on the connecting straight line between the two holes 11 within the same.

As can be deduced from FIG. 9, the two fixing slots 12 are for fixing the binding tongue strip 7 to the base plate 5. To this end, the binding tongue strip 7 is inserted from below with its two binding tongue ends 13, 14 through the fixing slots 12, until the central section 15 abuts the under-side of the base plate 5. In the region of the fixing slots 12, the bending tongue strip 7 is respectively bent upward at an angle of 90°, so that the binding tongues 13, 14 project upward vertically to the base plate 5. On these binding tongues 13, 14, the sheets 3 of the document stack 2 are mounted (FIG. 10).

Then the cover plate 6 is mounted as follows (FIG. 9) on the binding tongues 13, 14. The strip-shaped cover plate 6 (FIG. 3*a* and 3*b*) has on one side a perforation 16, which consists of the two holes 17. The latter lie flush in the position of use (FIG. 9) in the vertical direction with the holes 11 of the base plate 5. On the other side, a further perforation 18 is provided with holes 19 in the cover plate 6, which lie on the connecting straight line between the holes 17 within the same. The holes 19 lie flush in the vertical direction with the fixing slots 12 in the base plate 5 and are penetrated by the binding tongues 13, 14 of the binding tongue strip 7 (FIGS. 9 and 10).

The cover plate 6 has inside the perforation 18, parallel to the longitudinal line 9, a recess 40, into which the binding tongue ends 13', 14' are inserted in the assembled state (FIG. 4). Due to this recess 40, the entire height of the binding mechanism is reduced.

The profile rail parts 22, 22' are mounted on the cover plate 6 and then form a cover completely surrounding the same. The cover plate 6 has on both sides on its longitudinal edges 38 two notches each or end regions 20, 20' which widen in steps towards the cover plate ends. The profile rail parts 22, 22' have on their inner face respectively two steps complementary to the shoulders 20, 20' and therefore upon mounting from the two opposite ends of the cover plate 6 lock in the notches or shoulders 20, 20'.

In addition, the cover plate 6 has parallel to the longitudinal centre on either side a convexity 21, which upon pushing together of the cover profile halves 22, 22', by slight arching of the cover plate 6, imparts greater rigidity.

Furthermore, below the edge 30 between the cover profile rail parts 22, 22' an insertion stop 31 is integrally formed on the longitudinal sides 23, which projects into the insertion channel 25 and can lock with lateral catch elements 44 on the cover plate 6 and also with the shoulders 20, 20'.

As can be deduced from FIG. 9, the cover profile rail parts 22, 22' are provided in the assembled state of the binding mechanism with a perforation 33, whose holes 34 lie flush in the vertical direction with the holes 11 of the perforation 10 in the base plate 5 and with the holes 17 of the perforation 16 in the cover plate 6.

As can be deduced from FIGS. 8 to 10, the roughly centrally divided cover profile rail 8 has a peg-like cross-section with two cover parts lying on top in the position of use. In each cover part of the profile rail 8, grab webs 24 bent inward abut the longitudinal sides 23. These grab webs form with the cover part a respective insertion channel 25 for the cover plate 6 and the binding tongue ends 13, 14 bent on to the upper face of the cover plate 6. The insertion channel 25 has undercut regions 26 (FIG. 9) along its longitudinal sides, which run round in a semi-circle at the ends 29. The longitudinally oriented end edges 27 of the grab webs 24 have in the transverse direction a distance from one another which is sufficiently large that through the distance gap 28, the binding tongues 13, 14 and the clips of a binding mechanism not shown of a storage file can penetrate.

On the upper face of each cover profile rail part 22, 22', in the region of the edge 30, fluting 32 is provided (FIGS. 6 and 7), which when the cover profile rail 8 is pushed together may form the shape of an "X". This fluting 32 simplifies in handling the pushing open and shut of the cover profile rail halves. The two triangular regions 35 between the upper and lower branches respectively of the fluted "X" are respectively formed in one piece with one of the two profile rail halves 22, 22'.

By means of these triangular lugs 35, a seamless join is achieved between the profile rail halves 22, 22' in the closed state.

FIG. 6 shows the binding device in the state ready for use. Here, the two cover profile rail halves 22, 22' are only moved apart so far that the perforation 18 with the holes 19 in the cover plate 6 and the binding tongue ends 13', 14' drawn therethrough is visible.

To use the blinding device 1, the document stack is provided by means of a conventional hole punch with two pairs of perforations, one of which corresponds in the hole spacing to the perforations 10, 16 and 33 in the base plate 5, cover plate 6 and cover profile rail 8. The remaining two perforations in the document stack 2 correspond in their arrangement to the inner perforations 18 in the cover plate 6.

In order to bind the document stack 2, the binding tongues 13, 14, which project through the slots 12 in the base plate 5, are inserted from below through the perforation 18 (FIG. 9) in the cover plate, until the base plate 5 abuts the under-side 36 of the document stack 2 (FIG. 10).

Then the cover plate 6 with the two mounted cover profile rail parts 22, 22' with their inner perforations 18 is mounted on the upward-projecting binding tongues 13, 14 until the cover plate 6 comes to rest on the upper face 37 (FIG. 10) of the document stack 2. Thereafter, the binding tongue ends 13', 14' are bent back inward into the recess 40.

As FIG. 9 shows, then the divided cover profile rail 8 is mounted on the cover plate 6, including the bent-back binding tongue ends 13, 14. The rotating longitudinal edges 38 of the cover plate 6 come to rest in the undercut regions 26 of the profile rail 8. By the insertion stop 30 on both parts of the cover profile rail parts 22, 22', both cover profile rail parts 22, 22' lock, so that both parts are prevented from automatic backward movement. Only under slight pressure outwards can the two parts 22, 22' be released again from the position on the cover plate 6. In this case, the insertion stop 30 and the perforations 33 are so aligned in the divided cover profile rail 8 that in the stop position the holes 34 of the divided cover profile rail 8 lie flush in the vertical direction with the holes 11 or 17 of the base plate 5 or the cover plate 6 respectively. The mounting of the two cover profile rail parts 22 is simplified furthermore by the fluting 32, which furthermore clearly marks the insertion direction.

The cover profile rail 8 divided into two offers the further advantage that on each side of the cover profile rail halves 22, 22' two opposing leading eyes 42 and 43 respectively can be integrally formed. FIG. 11 shows the binding device with the cover profile rail divided into two and the leading eyes 42 and 43 respectively in the open state of the cover profile rail, where the further opening movement is limited at the shoulders 20, 20' of the cover plate 6 by stops on the projections 31 projecting into the undercut region 26 of the cover profile parts 22, 22'.

FIG. 12 shows how the closed cover profile rail parts 22, 22' are connected together at the opposite longitudinal side with their lateral eyes 42, through which leaded wire provided with a lead seal 44 are drawn. Alternatively, this is also possible for the leading eyes 43.

Through the outer perforations 10, 16, 33 penetrating all layers in the vertical direction, the document stack 2 can be secured with the described binding device in a standardised binding mechanism of a file or the like, wherein the clips penetrate the holes 11, 17 and 34 of the base plate 5, cover plate 6 and cover profile rail 8.

What is claimed is:

1. A device for binding together a stack of document sheets and, if desired, for depositing such a bound stack in a file with a filing mechanism, the device comprising: a base plate for being disposed below the document stack, a cover plate for being disposed on the document stack, at least one flexible binding tongue strip which is fixable to the base plate and has two binding tongues for binding together the document sheets by being threaded through paired perforations in the document stack and the cover plate and bent back at the ends on to the cover plate above the document stack, and at least one cover rail mountable on the cover plate enclosing the binding tongue ends, the cover rail having undercuts on longitudinal edges for encompassing longitudinal edges of the cover plate, the cover rail being divided into two parts in its longitudinal direction, so that the two parts are mountable from opposite end faces on the cover plate.

2. A device according to claim 1, wherein the cover rail is divided substantially centrally into cover rail parts, so that the cover rail parts have an identical shape.

3. A device according to claim 1 or claim 2, wherein the cover rail parts have on their edge a respective projection extending substantially over half their length and corresponding to a recess in another section of the edge.

4. A device according to claim 1 or claim 2 wherein the cover rail parts have, in the region of their edge, contouring which increases the skid-resistant properties.

5. A device according to claim 4, wherein grip regions are provided on an upper face and on both longitudinal edges of the cover rail parts.

6. A device according to claim 5 wherein the grip regions are embossed.

7. A device according to claim 5, wherein the grip regions have an arrow-like shape pointing in the insertion direction.

8. A device according to claim 1, wherein the undercut of the cover rail parts extends continuously around peripheral end faces of the cover rail parts.

9. A device according to claim 1 wherein the cover rail parts each have a perforation which is aligned with respective perforations of the base plate and the cover plate.

10. A device according to claim 1 wherein the cover rail parts have at regions adjacent to the edge, projections which project into the undercuts and which can engage lateral shoulders on longitudinal edges of the cover plate to counteract an opening movement of the respective cover rail part.

11. A device according to claim 10, wherein shoulders are formed at the longitudinal edges of the cover plate, close to end faces of the cover plate, the shoulders widening towards the end faces, wherein, in an open position of the cover rail parts the shoulders abut projections projecting into the undercuts and thereby limit opening movement.

12. A device according to claim 10 or claim 11, wherein lateral lugs are provided on the longitudinal edges of the cover plate, close to its centre, behind which projections, which project into the undercuts of the cover rail parts can engage for locking the cover rail parts in a closed position.

13. A device according to claim 1 wherein lead seal eyes are provided on the longitudinal edges of the cover rail parts close to their adjoining edges, through which a wire can be threaded, so that opening of the cover rail parts necessarily brings about destruction of a lead seal formed with the wire and is therefore immediately recognizable.

14. A device according to claim 10 wherein the cover plate has a widening substantially centrally between two end faces, such that projections of the cover rail parts abut the widening in the closed position and project into the undercuts and compress the longitudinal edges of the cover plate, forming a slight transverse arching thereof.

15. A device according to claim 1 wherein the cover plate has a groove-like recess in a region between inner perforations for insertion of bent-back binding tongue ends.

16. A device according to claim 1 wherein the cover plate and the cover rail parts are extended beyond outer perforations, in the range of 1.5 to 2.5 times the width of the cover plate.

* * * * *